US010190480B2

(12) United States Patent
Maki et al.

(10) Patent No.: US 10,190,480 B2
(45) Date of Patent: Jan. 29, 2019

(54) ENGINE COVER PLATE

(71) Applicant: Ford Global Technologies, LLC, Dearborn, MI (US)

(72) Inventors: Cliff Maki, New Hudson, MI (US); Thomas Polley, Livonia, MI (US); Jeffrey Allen Mullins, Allen Park, MI (US); Sonny E. Stanley, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 393 days.

(21) Appl. No.: 13/749,585

(22) Filed: Jan. 24, 2013

(65) Prior Publication Data

US 2014/0202403 A1 Jul. 24, 2014

(51) Int. Cl.
*F01P 11/08* (2006.01)

(52) U.S. Cl.
CPC ..... *F01P 11/08* (2013.01); *F01P 2060/16* (2013.01)

(58) Field of Classification Search
USPC ... 123/196 AB, 41.33, 73 AD, 73 PP, 196 R, 123/196 CP, 195 R, 195 C, 195 S
See application file for complete search history.

(56) References Cited

U.S. PATENT DOCUMENTS

| | | | | |
|---|---|---|---|---|
| 4,399,774 | A * | 8/1983 | Tsutsumi | F01P 7/167 123/196 AB |
| 5,690,062 | A * | 11/1997 | Yamada | F01M 5/002 123/196 AB |
| 6,216,658 | B1 * | 4/2001 | Pierro et al. | 123/193.2 |
| 7,178,500 | B1 * | 2/2007 | Belter et al. | 123/196 AB |
| 9,239,195 | B2 * | 1/2016 | Kim | F28D 9/005 |
| 2006/0016330 | A1 * | 1/2006 | Zhu et al. | 92/186 |
| 2006/0096556 | A1 * | 5/2006 | Groddeck et al. | 123/41.33 |
| 2009/0320471 | A1 * | 12/2009 | Palazzolo et al. | 60/624 |
| 2011/0253092 | A1 * | 10/2011 | Springer et al. | 123/196 R |

FOREIGN PATENT DOCUMENTS

| | | | |
|---|---|---|---|
| CN | 1735763 | A | 2/2006 |
| EP | 0965743 | A2 | 12/1999 |
| EP | 0965743 | A3 | 11/2000 |
| GB | 2189292 | A | 10/1987 |
| JP | 2009138621 | | 6/2009 |

OTHER PUBLICATIONS

State Intellectual Property Office of the People's Republic of China, Office Action and Search Report Issued in Application No. 201410030421.9, dated Apr. 21, 2017, 9 pages. (Submitted with Partial Translation).

* cited by examiner

*Primary Examiner* — Stephen K Cronin
*Assistant Examiner* — Ruben Picon-Feliciano
(74) *Attorney, Agent, or Firm* — Julia Voutyras; McCoy Russell LLP

(57) ABSTRACT

A engine block cover plate is described having a depression shaped to guide coolant flow around a bend in a coolant circuit, the plate further including a plurality of oil ports. One example method of operation may include guiding a coolant flow around a bend in a cooling circuit within an engine block via the cover plate, the cover plate having coolant and oil ports positioned therein, and adjusting a valve positioned on the cover plate to control a flow of oil through the oil port in response to an engine component temperature. In this way, flow losses may be decreased while enabling improved oil flow control with reduced system complexity.

19 Claims, 9 Drawing Sheets

ENGINE COVER PLATE

BACKGROUND AND SUMMARY

Internal combustion engines, such as those found in vehicles, may utilize a cooling circuit to reduce overheating. This may be achieved by a combination of engine oil cooling and liquid coolant cooling.

Liquid coolant absorbs excess heat from combustion and transfers the heat into the air or cabin of the vehicle via respective heat exchangers, such as a radiator and heater core. However, liquid coolant is isolated from the combustion chambers in order for ignition to occur; heat is therefore exchanged via conductive metal passageways surrounding the combustion chambers. These isolating passageways may be referred to as the water jacket. Coolant is accelerated through the engine by way of a fluid pump before entering the water jacket; this closed coolant circulation pathway referred to as the coolant circuit. Engine oil may undergo a similar heat exchange process within a separate circuit wherein oil is accelerated by an oil pump coupled to an oil injector within the engine block. This oil injector deposits oil on the underside of the piston where heat is absorbed and then deposited via a heat exchanger.

Conventionally, coolant fluid pumps are mounted onto the engine block surface and coupled to the engine water jacket. The high-pressure die casting manufacturing method used for engine production relies on the coolant passageways being linear. One way in which coolant exiting the coolant pump may be coupled to the water jacket using linear paths is by the creation of a cavity on the outside of the engine block sealed by a cover plate. In this way the coolant path can change direction without leaving the engine block. Conventional coolant cavities have a water pump outlet that opens into one side of the coolant cavity, and another side that is open to the water jacket. However, the inventors recognized that this abrupt change in coolant flow direction creates losses in fluid flow control.

This issue may be addressed by creating a coolant cavity configuration and cover plate to direct the flow of coolant from the water pump outlet port to the water jacket inlet port down a slope, thus decreasing flow control losses. In one example, a system for engine cooling comprises: a cover plate for a coolant passage, the plate including a coolant outlet port displaced away from a coolant inlet port, and a plurality of oil ports; and a coolant cavity, covered by the cover plate, within the coolant passage and coupled to a fluid pump and a water jacket.

Various additional advantages may be achieved in some embodiments. For example, the cover plate may enable reduction of the number of engine block components while meeting the increased demand on the cooling system by integrating a port for engine oil to enter the engine block via an attached valve. In doing so, the proximity of the engine oil and coolant is reduced and undesired heat absorption into the cooling system reduced to provide more effective cooling. The system may also reduce the need for an additional port and valve arrangement to pass oil into the engine block. Further, by actuating the oil valve in response to temperature sensors within the oil circuit, engine heating to a desired operating threshold can be expedited. Additional ports optionally incorporated into this cover plate also provide a solution to the distribution of oil and coolant to turbochargers, EGR, and other systems.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

BRIEF DESCRIPTION OF DRAWINGS

The subject matter of the present disclosure will be better understood from reading the following detailed description of non-limiting embodiments, with reference to the attached drawings, wherein:

FIGS. 2, 3, 4A, 4B, 5, 6, 7, 8, 9A, 9B, and 10 are drawn to scale, although other relative dimensions may be used.

DETAILED DESCRIPTION

The subject matter of the present disclosure is now described by way of example and with reference to certain illustrated embodiments. It will be noted that figures included in this disclosure are schematic, and are identified as such. In the schematic figures, views of the illustrated embodiments are all not drawn to scale; aspect ratios, feature size, and numbers of features may be purposely distorted to make selected features or relationships easier to see.

Figure 1:
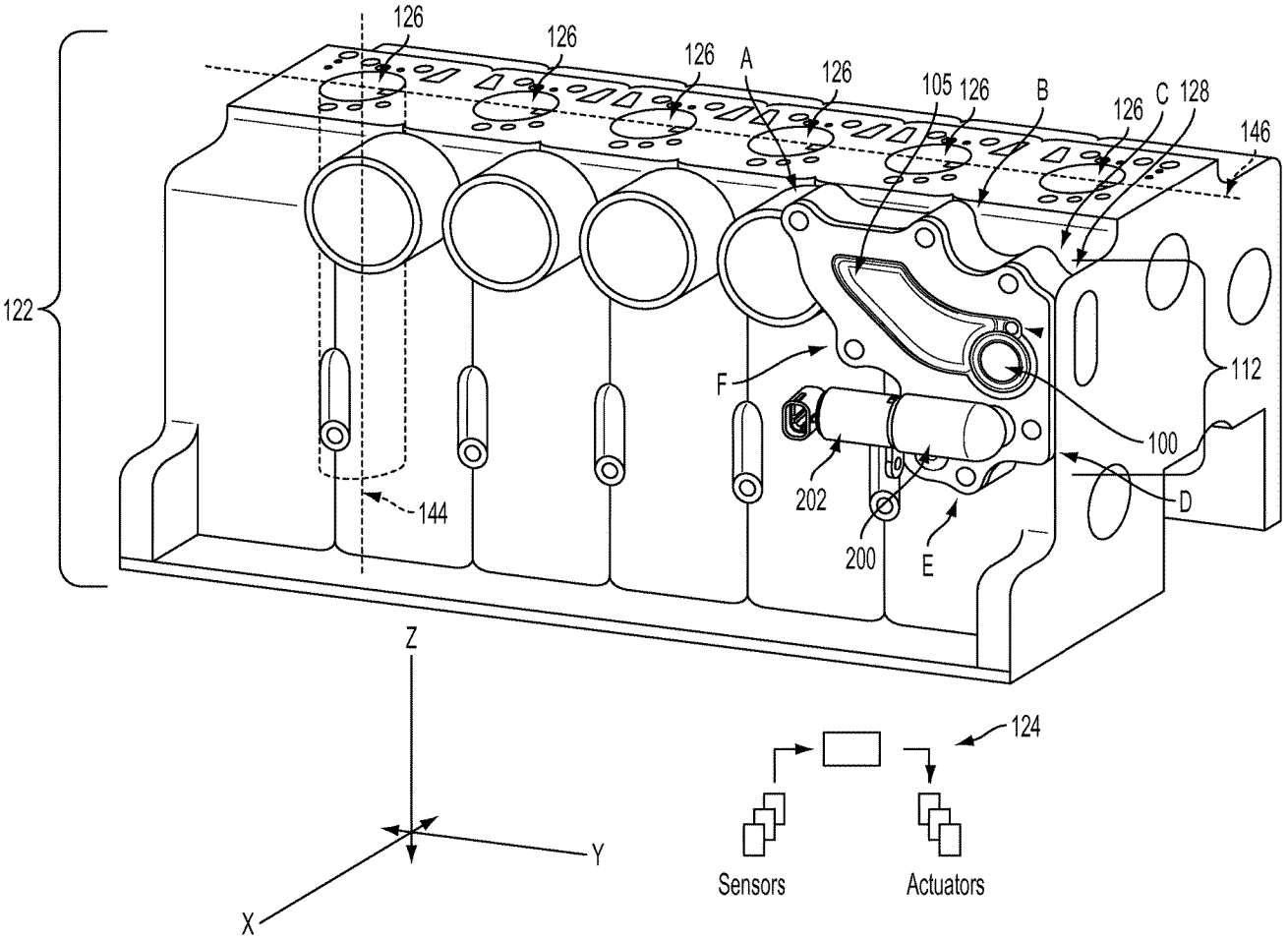
FIG. 1 shows an embodiment of an engine block with a coolant cavity and cover plate.

Methods and systems are provided for an engine block configuration and coolant cavity cover plate with integrated engine oil and coolant fluid coupling. FIG. 1 shows an example engine block 122 configuration compatible with the cover plate and an example cover plate 112. Coolant exiting a fluid pump is contained within the engine block by a cover plate bolted to a coolant cavity on the outer face of engine block. The cover plate also acts to fluidically couple the fluid pump to an engine water jacket opening. The inlet port of the coolant cavity may receive oil from the fluid pump and exit through the outlet port. Engine oil may be coupled via the cover plate to a multiplicity of valves actuated by a control system to meter the oil sent from the oil injector to the piston of a combustion engine. The alignment of ports within the coolant cavity creates a positive pressure differential between the inlet port and the outlet port and creates a more gentle cascade of fluid through the coolant cavity than previous configurations that have the inlet and outlet ports vertically aligned. In doing so, flow control losses created by the sharp bend in the coolant circuit are minimized. An increasing desire for compact engine size and minimal engine mass for increased fuel economy creates a further constraint on cooling system design. This can be achieved, in part, by minimizing the number of individual components of an engine system. The coupling of oil inlet port to the water jacket cover plate combines two components that would otherwise be independent, aiding in reducing engine size.

Figure 2:
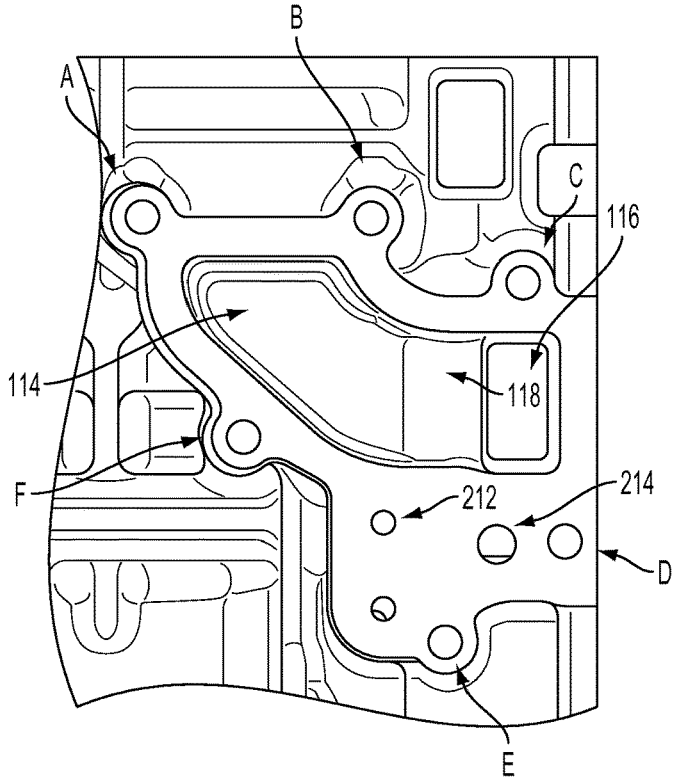
FIG. 2 shows a cover plate mounting surface.

FIG. 2 shows the engine block with the cover plate removed exposing the engine oil and coolant openings of the engine block and the laterally displaced fluid cavity. In this disclosure, the term "laterally" will be taken to mean a plane parallel to the engine combustion cylinder's plane of alignment 146 (FIG. 1) wherein an axis parallel to the y-axis passes through the center of the circular cross-section of each of the six cylinder chambers depicted in FIG. 1. The individual cylinders' vertical alignment line 144 (FIG. 1) is parallel to the z-axis of the plane; the x-axis is perpendicular to the lateral plane of the cylinder in these depictions. Specifically, a lateral plane is parallel to the y-z plane.

Figure 3:
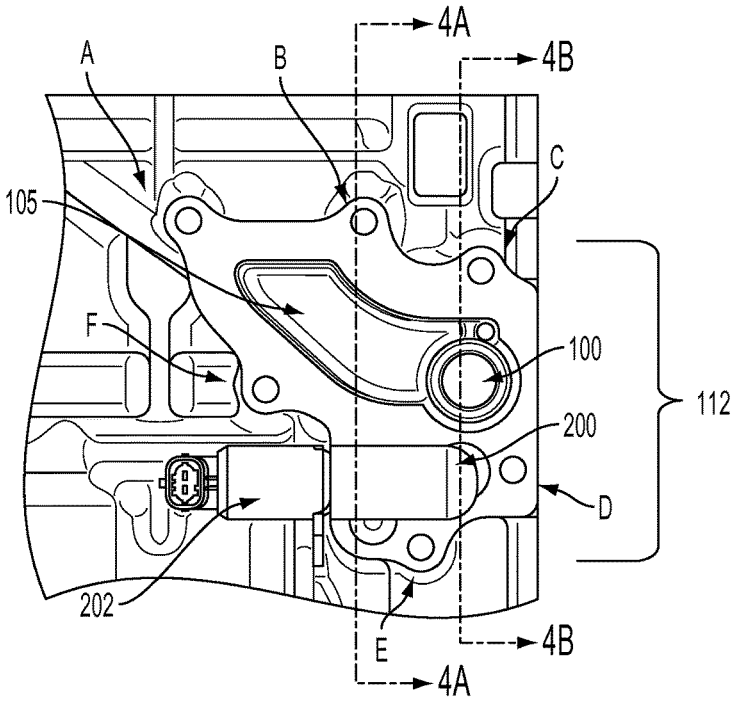
FIG. 3 shows a front view of an embodiment of the cover plate.
Figure 4B:
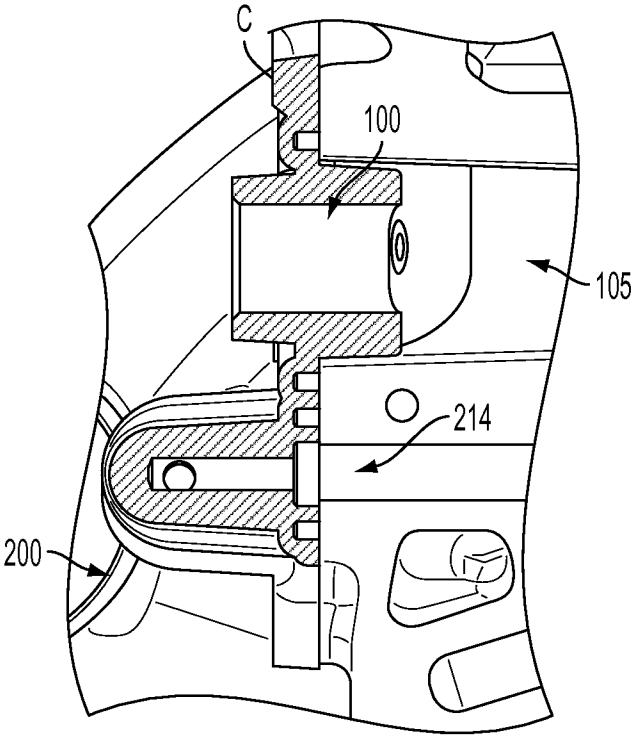
FIG. 4B shows an alternate cross section of the cover plate and engine block of FIG. 3.
Figure 4A:
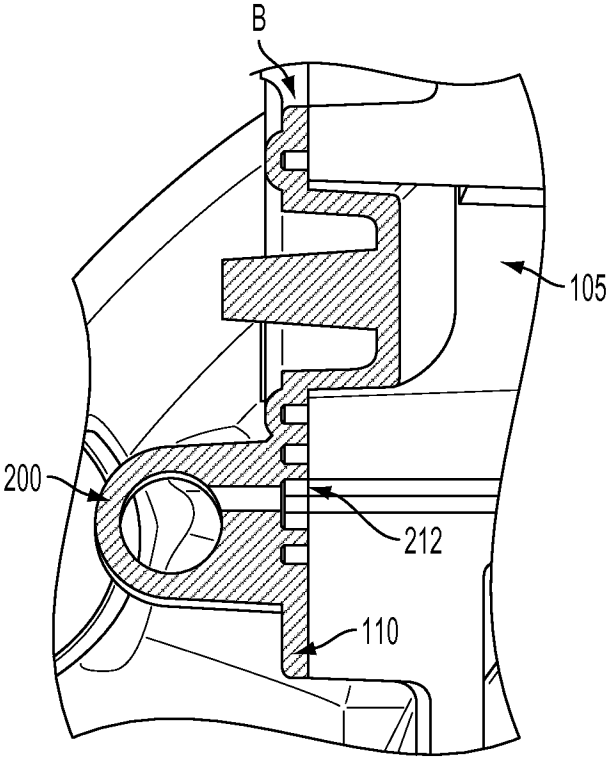
FIG. 4A shows a cross section of an embodiment of the cover plate and engine block of FIG. 3.
Figure 5:
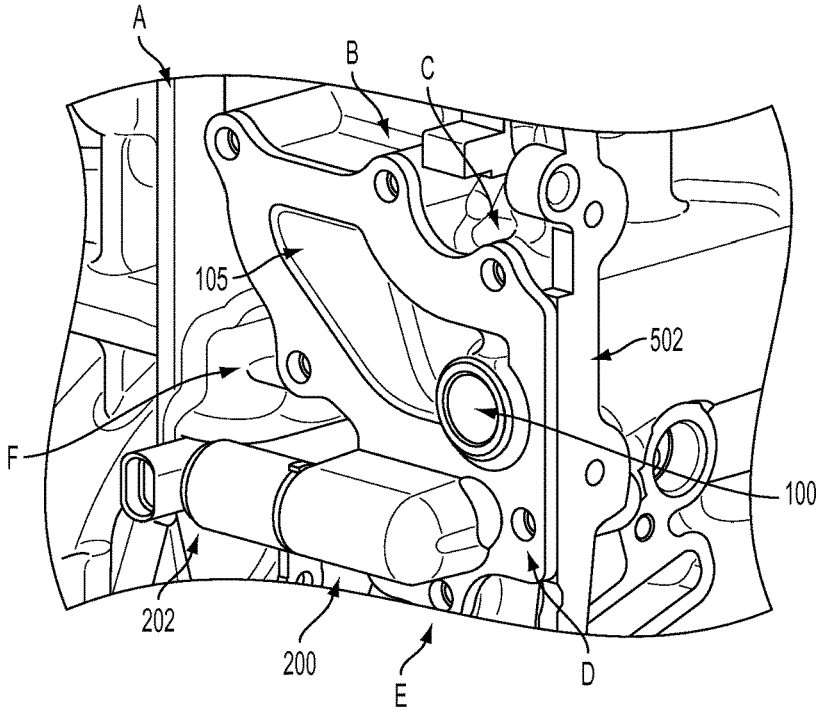
FIG. 5 shows a cross section of the cover plate and engine block of FIG. 3.
Figure 6:
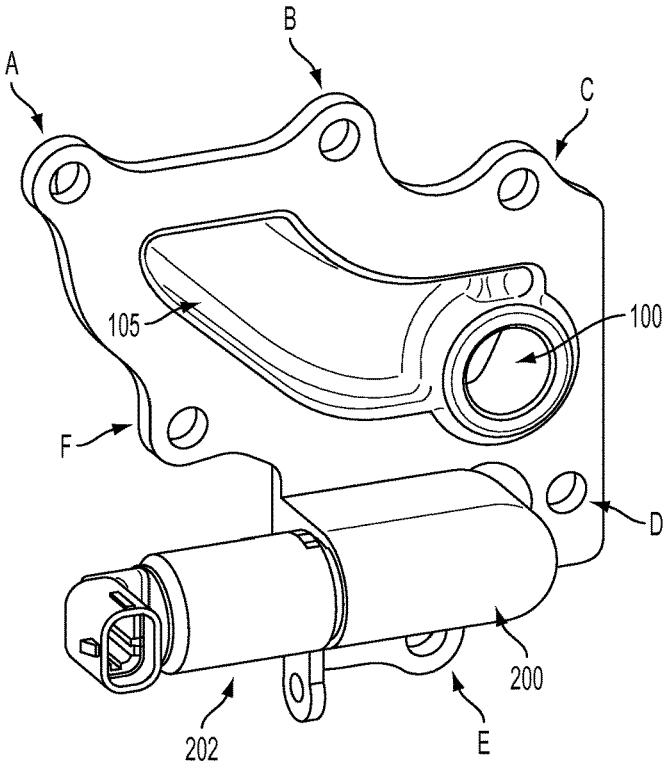
FIG. 6 shows the cover plate of FIG. 3 detached from the engine block.
Figure 7:
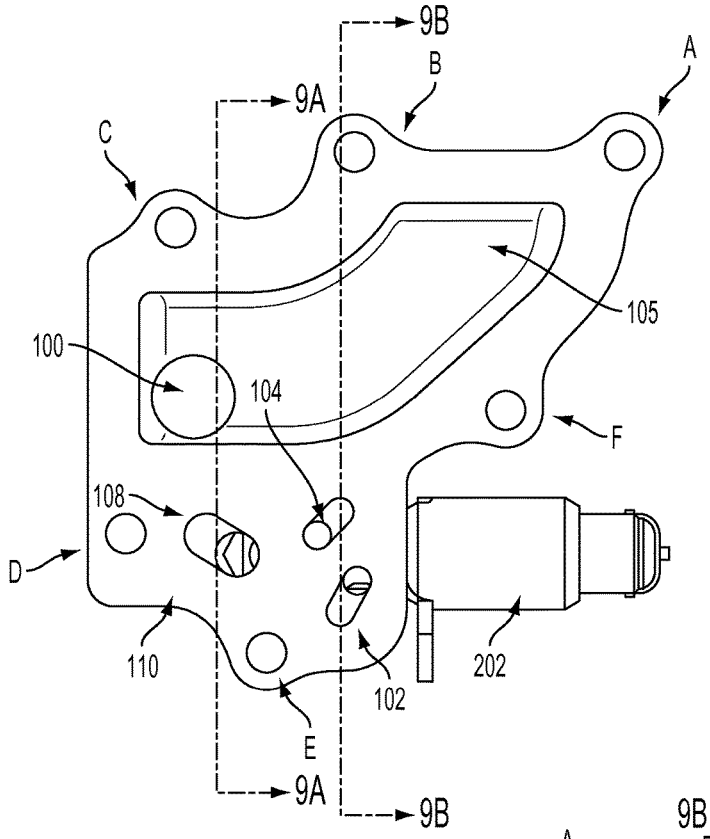
FIG. 7 shows the back of an alternate embodiment of a cover plate.
Figure 8:
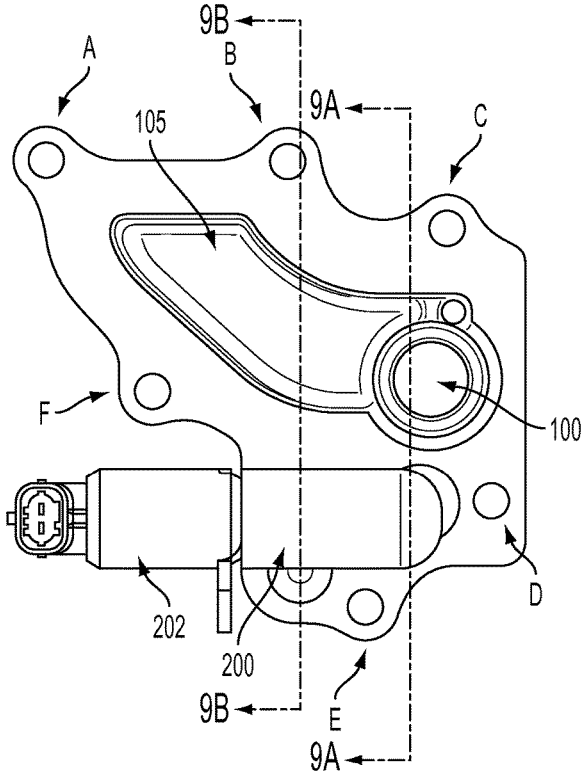
FIG. 8 shows the front of the cover plate of FIG. 7.
Figure 9A:
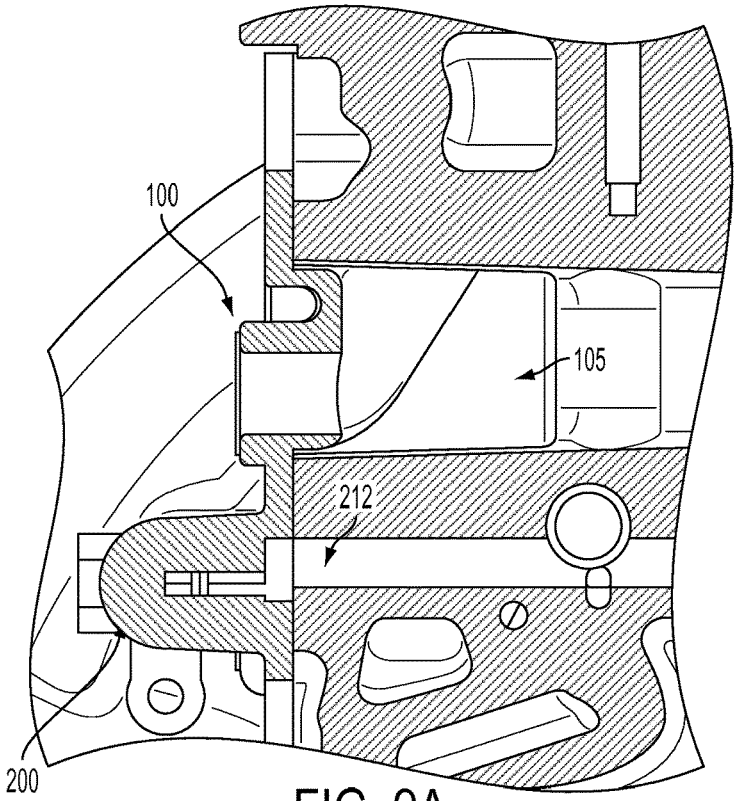
FIG. 9A shows a cross section of the cover plate of FIG. 7.
Figure 9B:
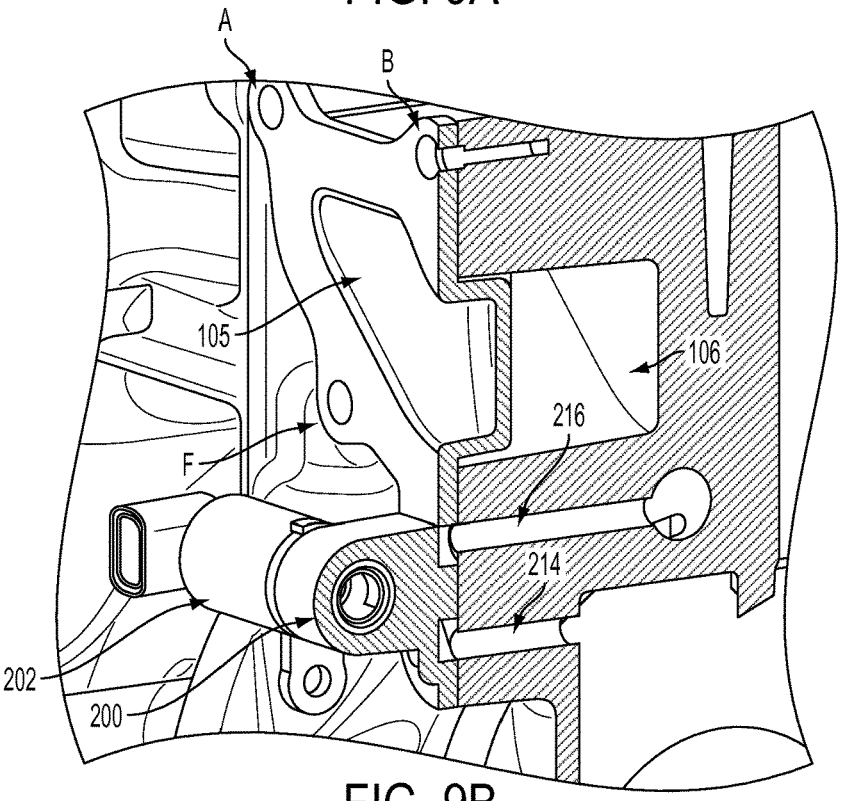
FIG. 9B shows an alternate cross section of the cover plate of FIG. 7.

A view of the cover plate from the outside of the engine block and the outside of the engine oil valve passage is depicted in FIG. 3. FIGS. 4A and 4B depict the cross-section of the cover plate and a portion of the engine block as indicated in FIGS. 2 and 3. A cross-section of the engine block and water jacket at the edge of the cover plate is depicted in FIG. 5 and the cover plate is shown independent of the engine block in FIG. 6. An alternate embodiment of the design may have multiple engine oil valves with various pressure ports to allow a precise flow of oil to the oil injectors, in FIG. 7 an embodiment of the cover plate with three engine oil valve openings is shown from the perspective of the engine block. FIG. 8 shows this embodiment from a perspective outside of the engine block. FIGS. 9A and 9B depict the cross-sections of this embodiment and a portion of the engine block as indicated in FIGS. 7 and 8.

Figure 10:
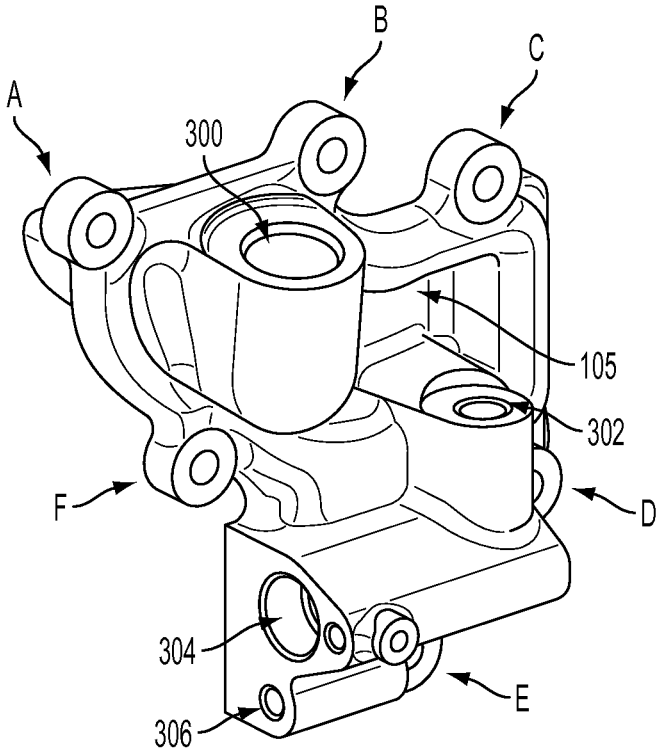
FIG. 10 shows an alternate embodiment of a cover plate.
Figure 11:
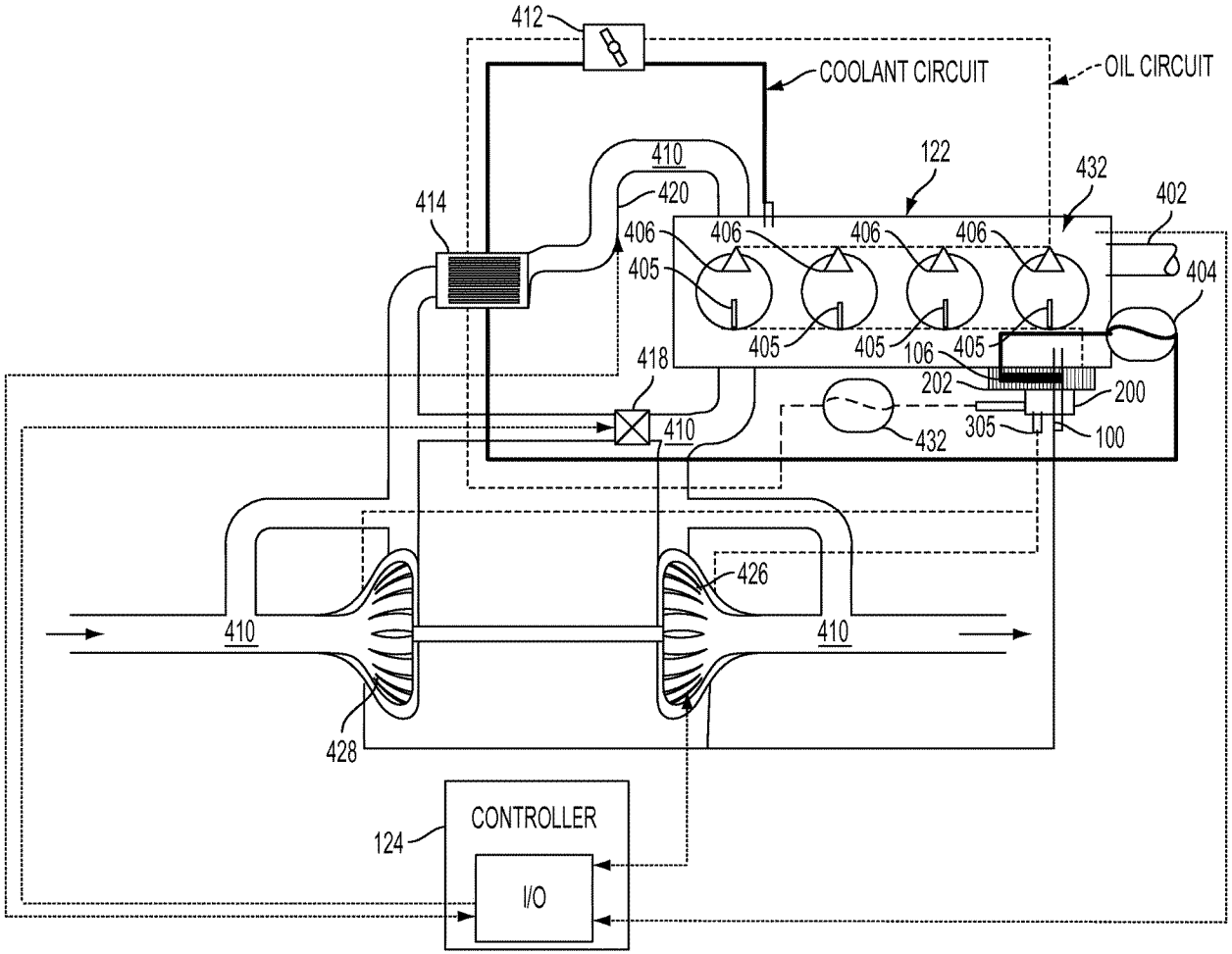
FIG. 11 schematically shows an embodiment of a liquid and oil cooling circuit.
Figure 12:
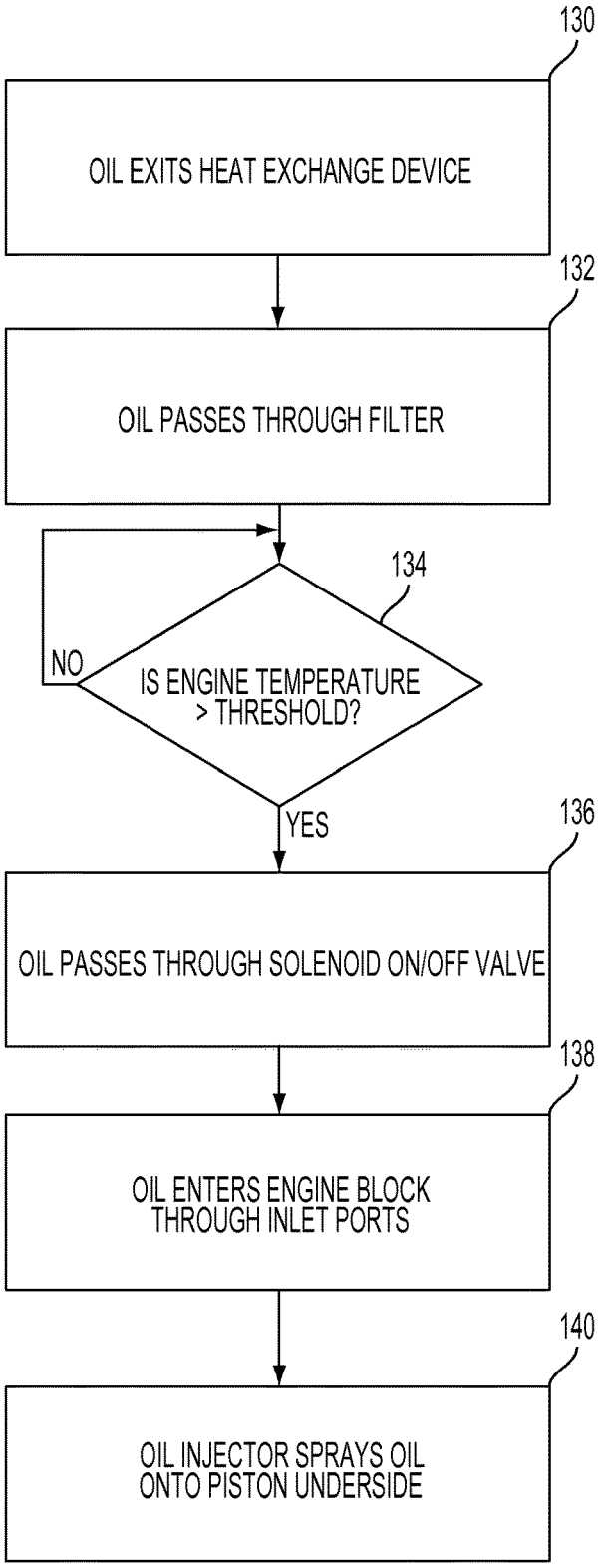
FIG. 12 is a simplified flow diagram of an example method of oil flow control.

Modern vehicles often have additional systems that utilize cooling, such as exhaust gas recirculation (EGR) or turbochargers. These systems often result in the expansion of one or both cooling circuits. FIG. 10 shows an embodiment of the cover plate from the outside of the engine block with passageways to distribute oil to the cooling system of an exhaust gas recirculation (EGR) system and turbocharger. The oil and coolant circuit of an embodiment employing external systems is schematically depicted in FIG. 11. The oil valve in these figures may be actuated by a control system configured to perform control routines as depicted in FIG. 12 where the flow of engine oil to the injectors may be initiated by components within the engine reaching a temperature threshold thereby decreasing the time for the engine to reach a desired temperature to achieve fuel economy and engine performance benefits. Despite the operation of cooling during most operating conditions, engine function improves at a temperature higher than ambient. Operation at cold temperatures can lead to decreased fuel economy. It may therefore be desirable to suspend engine cooling until this desired temperature is achieved. As such, the cooling system may operate to remove large amounts of heat from continuous combustions or increased combustion rates. Turbochargers further exert cooling systems by introducing additional mechanical processes that create heat from friction, as well as increasing the heat energy from combustion. The exhaust gas of an EGR system may also utilize cooling before circulation into engine combustion chambers, increasing the complexity and efficiency of a cooling system. It is therefore advantageous to have a cooling system that can be both ineffectual and increasingly proficient. The example configurations described herein improve efficiency by the close proximity of the oil port and coolant cavity while allowing oil cooling suspension via oil valve control.

Turning now to FIG. 1, an engine block and cover plate embodiment is shown for a six cylinder engine with coolant cavity cover plate 112, although it may be applied to other numbers of cylinders. The walls of the coolant cavity 120 end in a mounting surface (not shown) to which the cover plate is bolted, sealing coolant into the cavity and the engine block. The locations of six fasteners through the cover plate and into the engine block mounting surface are indicated throughout the figures by letter references A-F.

In FIG. 1 a fluid pump (not shown) may be coupled to coolant cavity enclosed by the slightly depressed cavity cover 105 with respect to the lateral plane of the engine block surface. The inlet of the passageway (not shown) may be in a parallel plane to the outlet 100 of the passageway and displaced downward and to the right if viewed from the outside of the engine block. In other embodiments the inlet opening may be on the raised edge 128 that forms the cavity. The inlet and outlet ports are fluidically coupled by a cavity created as a lateral depression of the engine block displaced laterally forward of the ports arched in the lateral plane with upward concavity in a shape resembling the depressed cavity cover 105. Fluid flowing through inlet-passageway outlet system will therefore change vector flow from a positive x-direction to the negative x-direction or from either y-direction to the negative x-direction. This sharp change in path is dictated by the high-pressure die casting manufacturing method of the engine wherein a linear core pin is used to create the coolant passage into and out of the engine block. However, this cavity configuration allows enhanced flow control by guiding fluid through a sloping passageway and not a steep drop.

Engine oil may enter the engine block 122 through oil valve 202 and into oil port 200. This valve may be actuated by control system 124 with instructions to meter the valve opening based on temperature sensors 126 within the engine block or elsewhere throughout the engine or engine oil circuit. The valve may also be opened at a temperature threshold. This embodiment allows the coupling of the oil circuit and coolant circuit to the engine to occur within a single, unitary, cover plate to achieve a more compact engine design. Further, the proximity of the circuits reduces undesired heat absorption from exposure to heated engine components.

FIG. 2 shows the cover plate mounting surface 110 of the engine block. The locations of six bolts through the cover plate and into the engine block mounting surface are indicated by letter references A-F. Coolant may enter the coolant cavity from the fluid pump through an engine block opening 114 and exit into the water jacket via engine block opening 116, causing fluid flow direction to rotate 180 degrees. Cavity wall 118 isolates a portion of the cavity from the water jacket. In this embodiment, engine oil passes into the engine block by way of openings 212 and 214 in the engine block. These ports may allow oil passage at the same pressure or may regulate oil passage by maintaining different oil pressure within the ports. The cover plate may be mounted on this surface, as depicted in FIG. 3. Coolant entering the cavity enclosed by the depressed cavity cover 105 may exit through outlet 100 into the engine water jacket or to other cooling circuits in systems such as EGR or a turbocharger. Oil entering the engine block may pass through oil valve 202 and through oil port 200.

FIG. 4A depicts the cross section of an embodiment of the cover plate on the engine's mounting surface along the line indicated in FIG. 3. Oil port 200 allows oil to pass from the oil valve 202 into the engine block through an opening 212 in the engine block. When this valve is open, oil may pass into the engine block to the oil injector (not shown) for piston lubrication and cooling. FIG. 4B shows the cross section of the embodiment of FIG. 3 taken along an alternate cross section. The outlet 100 of the coolant cavity may dispense fluid to the water jacket or to another cooling system. A secondary opening in the engine block may allow oil to pass into the engine block. This port may pass oil with the same pressure as the port in FIG. 4A, but it may also be a higher pressure port. Oil passage through this port is also controlled by the valve (not shown, see 202, FIG. 3) regulating passage through the port in FIG. 4A. The oil valve (not shown, see 202, FIG. 3) may be embodied as a solenoid valve actuated by the control system. The valve may open upon reaching a temperature threshold or may be adjusted in response to the temperature within the oil circuit or engine components.

The cross-section of the engine block at the edge of the cover plate in FIG. 5 couples the cavity (not shown, see 106, FIG. 9A) into the water jacket 502 of the engine block via inlet 204. Coolant is sealed into this cavity by depressed cavity cover 105. FIG. 6 shows the same embodiment as FIG. 5 of the cover plate when detached from the engine block. The integration of oil port 200 into the cover plate of the coolant cavity reduces the need for an external coupling system and allows for a compact engine block design.

The flow of oil to the oil injectors may be more precisely regulated by employing a plurality of passages into the engine block coupled to oil ports of varying pressure. The alternate embodiment of an engine cover plate from the perspective of the engine block is shown in FIG. 7. When the oil valve 202 is open, two high pressure pumps 104 and 108 and a low pressure port 102 are coupled to the oil port 200. Coolant exiting the fluid pump may pass through port 100 and be distributed to systems outside the engine block such as an EGR or turbocharger. FIG. 8 shows this embodiment from the outside of the engine block.

The cross section of this embodiment along the line indicated in FIG. 8 is shown in FIG. 9A where the high pressure oil port 108 is coupled to the engine block through an opening in the engine block 212. FIG. 9B shows an alternate cross section of the embodiment wherein a high pressure oil port allows engine oil to pass through an opening in engine block 214 and a low pressure oil port allows engine oil to flow through an opening in the engine block at 216.

The embodiment of the cover plate in FIG. 10 has ports to accommodate oil flow from the cooling system of a turbocharger into the cover plate oil valve at 306 while oil from an oil pump enters the engine block through valve 304. Coolant may enter through an additional cover valve from an EGR or turbocharger through external coolant port 300 and exit through port 302 to be circulated through an EGR or turbocharger cooling system.

A schematically represented embodiment of a coolant circuit and oil circuit in a system with a turbocharger and EGR is shown in FIG. 11. In this embodiment, oil exiting oil pump 432 is circulated into the oil valve 202 coupled to oil port 200 as well as an exterior branch of the circuit. Oil passing through the oil port 200 within cover plate 112 may be distributed to oil injectors 405 and sprayed on the underside of pistons. This oil may then drip into an oil pan 406 and continue through the oil circuit to thermostat 412 coupled to a radiator 414 or a heating core (not shown) before returning to the oil pump 432. Similarly, coolant pump 404 is fluidically coupled to the coolant cavity 106 between the engine block 122 and the cover plate 112. At outlet port 100, coolant may be circulated into engine water jacket 432 or to an external system. Coolant through the water jacket may absorb heat of combustions within this portion of the coolant circuit. Coolant may also pass through a thermostat 412 where it may be distributed to the heating core or coupled to radiator 414 before returning to coolant pump 404. EGR Cooler 414 may also cool exhaust gas in systems employing EGR. Exhaust gas may exit the engine, pass through the EGR cooler, be distributed to a turbocharger, or any combination thereof, and be circulated back into an air intake through exhaust passage 410. Oil passing through oil valve 202 may also pass to external systems such as the cooling system for a turbocharger compressor 426 or the cooling system for a turbocharger turbine 428. Similarly, coolant that does not enter water jacket 432 via outlet port 100 may be circulated to the cooling system of a turbocharger compressor 426 or the cooling system of a turbocharger turbine 428. Distribution to one or both of these external circuits may be coupled to the cover plate herein. The port may also couple other systems to the oil or coolant circuit that have not been explicitly stated.

The simplified flow diagram in FIG. 12 is an example method of regulating oil flow to the piston oil injectors by the control circuit. Oil exiting a heat exchange device at 130 may pass through an oil filter 132 for contaminate removal. A valve may be actuated by a control system with sensors within the engine or oil circuit at 136. If a temperature threshold within the engine or oil circuit is reached at 136, the valve may open at 134 allowing oil to pass through the cover plate inlet valves. If the temperature is not above the threshold value, the valve may remain closed until that value is reached. An open valve will permit oil passage to the oil injectors in the engine block. In other embodiments (not shown), oil passing through the cover plate oil valve may be circulated to systems outside of the engine block, such as a turbocharger or EGR cooling system. Embodiments may also have additional cover plate oil valves actuated by a control system with sensors in an EGR, turbocharger, or other external circuit. By this method oil may be allowed to flow to other components while still being prohibited from entering the engine block. Oil valves with variable flow opening may be adjusted in response to the temperature sensors allowing for increased oil flow with increased temperature. By limiting or eliminating the oil to the engine when the engine is below a temperature threshold, the engine may reach a desired temperature more quickly thus increasing the engines fuel economy.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for engine cooling, comprising:

a cover plate for a coolant passage, the cover plate comprising a depression, coupled to a side of a cylinder block, and positioned adjacent to a water jacket of a cylinder, the cover plate including a coolant outlet port displaced away from a coolant inlet port, and a plurality of oil ports, where at least one of the oil ports is located in the cover plate and fluidly coupled to one or more piston oil injectors, the depression of the cover plate extending into a coolant cavity within the side of the cylinder block, a surface of the depression which contacts a coolant being sloped in an arc in a lateral plane with upward concavity, where the lateral plane is parallel to a y-z plane defined by a y-axis and a z-axis, the z-axis in the direction of gravity, and where the coolant inlet port is located in a higher portion of the coolant cavity than the coolant outlet port with respect to gravity, the coolant outlet port displaced away from the coolant inlet port both in a direction of the y-axis and the z-axis; and the coolant cavity, covered by the cover plate, within the coolant passage and coupled to a fluid pump and the water jacket.

2. The system of claim 1, wherein the oil ports are coupled to a valve actuated by a control system with instructions to open the valve when an engine or an engine component has reached a temperature threshold, wherein the cover plate includes a planar surface arranged around an outer edge of the cover plate and surrounding the depression, the planar surface coupled to a mounting surface of the side of the cylinder block, and wherein the depression and the planar surface form the cover plate and are continuous with one another.

3. The system of claim 1, wherein one of the piston oil injectors spray oil onto an underside of a piston where the oil is further delivered to an oil circuit fluidly coupled to a radiator, the radiator comprising a thermostat.

4. The system of claim 1, wherein the depression is a lateral depression of the cover plate which contains the coolant within the coolant cavity, wherein the cover plate is a unitary cover plate comprising the depression and an outer, planar surface, where the planar surface couples to the side of the cylinder block and is parallel to the lateral plane, and wherein the depression depresses away from the planar surface and into the coolant cavity, in a direction normal to the lateral plane.

5. The system of claim 1, wherein a portion of the coolant cavity is separated from the water jacket by a cavity wall and wherein the coolant cavity is depressed from an outside of the cylinder block into the side of the cylinder block.

6. The system of claim 1, wherein the coolant outlet port is at a lower pressure than the coolant inlet port.

7. The system of claim 1, wherein an oil control valve is positioned at least partially within the cover plate.

8. The system of claim 1, wherein the cover plate comprises ports to accommodate oil flow from a cooling system of a turbocharger into a cover plate oil valve.

9. The system of claim 1, wherein the coolant travels from the fluid pump through an engine block opening and into the coolant cavity, and wherein the coolant changes direction while contacting the sloped surface of the depression and exits through an outlet in the cover plate into the water jacket.

10. A component, comprising:

an engine block cover plate having a depression shaped to guide a coolant flow around a bend in a coolant circuit, the bend adjacent to and spanning at least a portion of a water jacket of a cylinder of a cylinder block, the depression extending into a coolant cavity within a side of the cylinder block and containing coolant within the coolant cavity; and the cover plate further including a plurality of oil ports fluidly coupled to one or more piston oil injectors, and where the depression of the cover plate is continuous with and depressed away from an outer, planar surface of the cover plate, the planar surface surrounding the depression and including a plurality of holes for fastening the planar surface to a mounting surface of the cylinder block.

11. The component of claim 10, wherein the cover plate depression includes an angled shape which is contiguous with a coolant outlet port in the cover plate and forming part of the bend within the coolant circuit.

12. The component of claim 11, wherein the coolant flow enters the coolant cavity in an engine block, is guided around the bend via the angled shape of the depression and exits the engine block via a port in the cover plate and wherein the coolant cavity is depressed from the mounting surface of the cylinder block into the side of the cylinder block.

13. The component of claim 12, wherein the depression contains the coolant flow within the coolant cavity in the engine block.

14. A method, comprising:

guiding a coolant flow around a bend in a cooling circuit within a cavity in an engine block via a cover plate positioned on an exterior of the engine block, wherein a depression in the cover plate extends into the engine block cavity and forms part of the bend which alters a direction of coolant flow such that the direction becomes opposite or perpendicular to a direction of coolant flow directly upstream of the bend, the cover plate having coolant and oil ports positioned therein, where the oil ports are fluidly coupled to one or more piston oil injectors, where the depression in the cover plate is continuous with and depressed away from an outer, planar surface of the cover plate, the planar surface surrounding the depression and including a plurality of holes for fastening the planar surface to a mounting surface on the exterior of the engine block; and adjusting a valve positioned on the cover plate to control a flow of oil through the oil ports at a variety of pressures in response to an engine component temperature.

15. The method of claim 14, wherein a portion of the cavity of the cooling circuit is isolated from a water jacket by a cavity wall and wherein the cavity is depressed from the exterior of the engine block into a side of the engine block.

16. The method of claim 14, wherein the valve is mounted in the cover plate.

17. The method of claim 16, further comprising cooling an EGR cooler with the cooling circuit, wherein the planar surface is arranged parallel with the mounting surface on the exterior of the engine block, and wherein the depression extends away from the planar surface and into the engine block cavity in a direction normal to the planar surface.

18. The method of claim 14, wherein the piston oil injectors receive oil from the oil ports of the cover plate, where the oil is sprayed onto an underside of one or more pistons before flowing to a radiator coupled to a thermostat.

19. The method of claim 14, wherein the coolant flow enters the cavity from a coolant pump and exits the engine block via an outlet in the cover plate.

* * * * *